United States Patent [19]

Cease et al.

[11] 4,148,740

[45] Apr. 10, 1979

[54] PREPARATION OF OVERBASED MAGNESIUM SULFONATES

[75] Inventors: Vincent J. Cease, Media, Pa.; George R. Kirk, Newark, Del.

[73] Assignee: Witco Chemical Corporation, New York, N.Y.

[21] Appl. No.: 901,877

[22] Filed: May 1, 1978

[51] Int. Cl.[2] ..... C10M 1/40; C10M 3/34; C10M 5/22; C10M 7/38

[52] U.S. Cl. ..... 252/33.2; 252/33; 252/389 R; 252/400 R

[58] Field of Search ..... 252/33, 33.2, 389 R, 252/400 R

[56] References Cited

U.S. PATENT DOCUMENTS 3,865,737 2/1975 Kemp ..... 252/33

*Primary Examiner*—Delbert E. Gantz
*Assistant Examiner*—Irving Vaughn
*Attorney, Agent, or Firm*—Albert L. Gazzola; Morton Friedman

[57] ABSTRACT

Process of preparation of fluid overbased, particularly highly overbased, magnesium-containing colloidal dispersions wherein a partial mixture is formed of an oil-soluble sulfonic acid as such or admixed with an oil-soluble aliphatic hydrocarbon monocarboxylic acid, a volatile aliphatic or aromatic or chlorinated hydrocarbon solvent, a special grade or readily reactive form of magnesium oxide for neutralization and overbasing purposes, and an alcohol, carbonating the mixture with a controlled limited amount of carbon dioxide, in the presence of an added activator, adding a nonvolatile diluent oil, stabilizing the colloidal dispersion, removing undesired sediment and then heating to distill off the volatile materials. The final overbased compositions have excellent utility as lubricating oils for use in diesel engines and internal combustion engines, and they possess, among other properties, corrosion inhibiting and antioxidant properties, the ability to reduce engine wear and to inhibit formation of undesirable and harmful deposits on engine parts. In the process, a stabilized post-reaction composition is produced, as indicated above, utilizing a limited amount, which is substantially less than the stoichiometric amount, of carbon dioxide per mole of overbasing magnesium present.

28 Claims, No Drawings

PREPARATION OF OVERBASED MAGNESIUM SULFONATES

Our present invention is directed to improvements in the preparation of fluid, particularly highly basic or highly overbased magnesium-containing dispersions. The dispersions of the general type to which the present invention relates are disclosed in many patents, illustrative of which is U.S. Pat. No. 3,865,737, which latter summarizes generally the prior art, and the disclosures of which U.S. Pat. No. 3,865,737 are incorporated herein by reference for background and prior art knowledge as well as for the disclosure of the particular process which constitutes the invention of said U.S. Pat. No. 3,865,737 which, of course, is also a part of the prior art. Indeed, our present invention is particularly concerned with what are important and significant improvements and advantages over the invention of and the process disclosed in said U.S. Pat. No. 3,865,737. The magnesium compounds present in the final compositions are apparently in the form of magnesium carbonate/magnesium hydroxide in colloidal form dispersed in the diluent oil.

While our invention and particularly advantageous embodiments thereof, including the best embodiments thereof of which we are presently aware, will be fully disclosed hereafter, we may note here, briefly, and in summary form, significant features of our invention, including important advantages which our invention possesses over the invention and process of the aforementioned U.S. Pat. No. 3,865,737.

1. The practice of the process of our invention results in the production of a "stabilized" post-reaction mass that provides from 24 to 240 hours post-reaction stability, and that allows for product clarification via centrifugation prior to solvent and water removal, so that, generally, there is no need to filter or centrifuge the dehydrated product.

2. Our process defines particular magnesium oxide properties necessary to achieve optimumization of desired results and to achieve particularly efficient utilization of the magnesium oxide.

3. Our process makes possible the use of as little as about 75% (or even somewhat less as noted below) of the stoichiometric quantity of carbon dioxide to be used in the reaction to accomplish the stabilization of the post-reaction mass.

4. Our process readily enables the production of fluid handleable products to be made having total base numbers exceeding 500, e.g. 550 to 575 or more.

5. Our process is not restricted to the use of aliphatic volatile solvents as is the process of U.S. Pat. No. 3,865,737, but permits the use, also, of volatile aromatic and chlorinated hydrocarbon solvents, thereby enhancing the versatility of our process.

In the practice of the process of our invention, as distinguished from that of U.S. Pat. No. 3,865,737, for instance, instead of preparing an initial mixture of all of the ingredients, other than the matter of inclusion of nonvolatile diluent oil, prior to the carbonation step, as in the process of U.S. Pat. No. 3,865,737, in our process, an initial blend or mixture is made of only some of the total ingredients. Thus, initially, the oil-soluble sulfonic acid or sulfonic acid-containing constituent, preferably in solution in hexane or other similar hydrocarbon solvent, and a volatile organic solvent are charged to the reactor with the alcohol constituent. Then the magnesium oxide having the particular specifications described below is added in an amount to effect neutralization or substantial neutralization of the oil-soluble sulfonic acid constituent, and an additional relatively large amount of said magnesium oxide is added to effect overbasing to the desired total base number (TBN), mixing or agitation of the reaction mixture being effected to keep the magnesium oxide well mixed and in suspension. Then carbonation of the reaction mixture is carried out, commonly in a period of 2 hours, more or less, depending, for example, on the volume of the reaction batch or mixture, but, importantly, using only about 75% (± about 10%) of the stoichiometric amount of carbon dioxide per mole of overbasing magnesium present, as distinguished from the at least 1 mole of carbon dioxide per mole of overbasing magnesium present used in the process of U.S. Pat. No. 3,865,737. The temperature is controlled, generally in the range of from about 70° to about 125° F., especially advantageously in the range of about 80° to about 110° F. During the early stages of the carbonation step, in which carbon dioxide gas is blown into the reaction mass, desirably in the first approximately 30 to 40 minutes thereof, an activator is added which desirably comprises a mixture of ammonia, water and methyl alcohol and/or the monomethyl ether of ethylene glycol (methyl "Cellosolve"). Following the carbonation step, to the extent that no nonvolatile diluent oil or a lesser amount than is ultimately to be utilized was added to the initial charge, nonvolatile diluent oil is added. No refluxing is necessary and, therefore, most advantageously no refluxing step is utilized. The reaction mass is then advantageously cooled as promptly as is reasonably feasible to a temperature which most desirably does not exceed about 100° F. and, better still, is in the range of about 70° to about 90° F., where the mass remains for an appreciable period of time as a stable colloidal dispersion which can readily be clarified by centrifugation. The clarified product is then distilled at a suitable temperature, for instance, about 300°-320° F. to remove water and volatile solvents. In the usual case, sediments of less than 0.1% are obtained in the finished product and no further clarification ordinarily is required. Products having TBNs in excess of 500 and, if desired, in the range up to about 550 or 575 or even higher are readily obtained. TBNs are determined in accordance with conventional procedures and, as here used, it is measured by the mg of KOH per gram of sample.

Referring back to the carbonation step, it is particularly important that certain parameters be followed if optimum results are to be achieved. Thus, during the carbonation step, the temperature of the reaction mixture undergoing carbonation should be maintained in the range of from about 70° F. to not substantially above 125° F. because, even at a temperature not in excess of about 130° F., decomposition of the ammonium compound (from the activator) used to effect or enhance solubility/reactivity of the magnesium oxide occurs which leads to an impairment of optimum results.

Furthermore, as noted above, the amount of carbon dioxide employed, in relation to the overbasing magnesium present, must be controlled to being distinctly below the theoretical or stoichiometric amount necessary to react with the overbasing magnesium present. The theoretical or stoichiometric amount of carbon dioxide is 1 mole per mole of overbasing magnesium present, as shown in U.S. Pat. No. 3,865,737. We have found, as noted above, that the amount of carbon dioxide should not fall outside of the range of 75% (±10%)

of the stoichiometric amount per mole of overbasing magnesium present. If it exceeds the upper value 75% (+10%), namely, about 82.5% of the amount of overbasing magnesium present, product sediment values/clarity are detrimentally affected and product stability during post-reaction sediment removal tends to be adversely affected. If the amount of carbon dioxide used is more than 10% below the aforesaid 75% of the stoichiometric amount, then the carbonation is insufficient to achieve the objectives of our invention.

In general, it is desirable that the nonvolatile diluent oil, or the major amount thereof in the case where some of the nonvolatile diluent oil has been included in the initial mixture of ingredients, be added following the carbonation step, and then that the temperature of the mixture be brought down to about 100° F. or below by force-cooling. As indicated above, following the carbonation step, it is neither necessary nor desirable to heat the reaction mixture to reflux temperature for a short period of time, which refluxing procedure represents a step which is indicated as being desirable at times in the process of U.S. Pat. No. 3,865,737. Such refluxing step represents an extra step, involves extra expense, and serves no favorable purpose in the process of our invention since stabilization of the post-reaction admixture is readily effected by the cooling step used in our process.

As noted above, following the cooling of the reaction mass, removal of unreacted solid material is readily accomplished by centrifugation prior to distillation and removal of the process solvents. This mode of clarification is particularly desirable because of the ease of removability of the solid materials due to the reduced viscosity of the liquid to be clarified, the large difference in specific gravity between the solid materials to be removed and the clarified liquid, and the reduced losses of product through centrifugation. The volatile hydrocarbon solvent and the process solvents and any water in the system are then removed by distillation to approximately 300° F. to 325° F., after which distillation step the product is stripped with inert gas to remove essentially all traces of the hydrocarbon solvent, the process solvents, and water.

The magnesium oxide which is especially advantageously utilized in the practice of our invention, particularly for the preparation of overbased magnesium sulfonate dispersions having base numbers in excess of 500, is generally characterized by the following combination of properties of Table I.

Table I

| | |
|---|---|
| Iodine Number | 40 (minimum) |
| Crystal Size | 150 to 400 Å |
| Bulk Density | 18 to 25 lbs/cu.ft. |
| Surface Area | 40 to 70 $M^2/g$ |
| Ignition Loss | 6.0 wt. % (maximum) |
| Acid Neutralization Time (A.N.T.) | 12 sec. (maximum) |

The aforesaid magnesium oxide is utilized, as noted above, in conjunction with and as a part of the process in which substantially less than one mole, namely, about 0.75 (±10%) moles of carbon dioxide, per mole of overbasing magnesium (or, as stated above, 75% (±10%) of the stoichiometric amount per mole of overbasing magnesium present), is used in the carbonation step of the process of our invention.

The foregoing properties of magnesium oxide are important from the standpoint of the reactivity of the magnesium oxide used in the practice of our invention. The extent of calcination is influenced by the calcination temperature or range of temperatures of the magnesium carbonate and/or magnesium hydroxide used in the production of the reactive magnesium oxide.

A variety of analytical methods is available and can suitably be utilized to determine adequacy of reactivity but exact correlations between various test methods for predetermining adequacy or reactivity, as a practical proposition, is not possible. We have found, somewhat generally, that acid neutralization time (A.N.T.) for the magnesium oxide and ignition loss wt. percentages are preferred quality control procedures and offer reasonable guideposts for predetermining satisfactory reactivity and reasonable bases of evaluation for substantial optimal reactivity of the magnesium oxide. Other measurements which we have found as being somewhat of a basis for predetermined controls for suitable reactivity of the magnesium oxide involve surface area as a measure of the particle size and shape and iodine numbers, these being, at times, factors which have an influence on the reactivity of the magnesium oxide. Such dependent variables in relation to the magnesium oxide not infrequently serve to indicate suitable reactivity of the magnesium oxide even if the acid neutralization number (A.N.T.) and/or the ignition losses do not conform to what would be expected to indicate a fully satisfactory or substantially optimum extent of reactivity for the magnesium oxide. In general, fully satisfactorily reactive magnesium oxides will be found when a plurality of the aforesaid control factors are met, but this is not always the case. Commonly, an acid neutralization time (A.N.T.) of about 12 seconds maximum and ignition losses of about 6 wt. % represent parameters which will indicate a magnesium oxide reactivity of suitable character. More desirably, additional parameters such as surface area of about 40 $M^2/g$ (minimum) and iodine number ($I_2$) of not less than about 40 are additional parameters to be considered together with the A.N.T. and ignition losses. Satisfactory reactivity has been found in the case of numbers of magnesium oxides which are included in the following Table II:

Table II

| MgO Sample No. | ANT, Seconds | Ignition Loss wt. % | Surface Area $m^2/g$ | $I_2$No. | Sediment/ Clarity/ |
|---|---|---|---|---|---|
| A | 9 | 1.2 | 31 | 49 | 3.2 |
| B | 15 | 1 | 28 | 33 | 4.8 |
| C | 19 | 1.07 | — | 18 | 9 |
| D | 8 | 7.2 | — | 70–80 | 9 |
| E | 13 | 1.7 | — | 30 | 5.6 |
| F | 8 | 3 | 47 | — | 2.6 |

Sediment/clarity values for satisfactory reactivity are desirably not in excess of about 5 and, still more desirably, are not in excess of about 3.5. From this standpoint, therefore, the magnesium oxides of Samples A, B and F had excellent reactivity, while those of Samples C, D and E were not as satisfactory though, to be sure, operable. Generally, in most cases, where a combination of the properties indicated in Table I is present, the magnesium oxide will tend to have satisfactory reactivity but this is not always the case. The foregoing analytic values and criteria are intended mainly as guides. A simple empirical test can, however, readily be run in the case of any particular magnesium oxide intended to be used, and a measure of its reactivity and reasonable suitability be ascertained by the sediment/clarity value which, as noted above, should advantageously not exceed about 5. For convenience, the simple terminology "reactive magnesium oxide" will be used to indicate magnesium oxides suitable for use in the practice of our invention.

The oil-soluble sulfonic acid dispersing agents which are utilized in the practice of the process of our invention are per se well known to the art and they include, by way of illustration, natural or synthetic sulfonic acids examples of which are oil-soluble mahogany sulfonic acids; postdodecylbenzenes, and "NAB Bottoms," which, generally speaking, comprise mixtures of monoalkylbenzenes and dialkylbenzenes, in which the dialkylbenzenes generally predominate and in which the alkyl groups are branched chain or linear and contain predominately from 12 to 16 carbon atoms. They may be used alone or in admixture with other oil-soluble sulfonic acids or in admixture with oil-soluble aliphatic hydrocarbon monocarboxylic acids. Numerous other suitable oil-soluble sulfonic acids, and admixtures thereof with oil-soluble aliphatic hydrocarbon monocarboxylic acids can be used which, by further example, are disclosed in columns 5, 6 and 7 of the aforesaid U.S. Pat. No. 3,865,737, as well as in, for instance, U.S. Pat. No. 3,525,599, the disclosures therein with respect thereto being incorporated herein and made a part hereof by reference. Particularly suitable for use in the practice of our present invention is a commercial oil-soluble sulfonic acid which is a postdodecylbenzene bottoms product in solution in hexane and having the following analysis:

| | |
|---|---|
| Sulfonic Acidity, meq./g | 0.55 |
| Total Acidity, meq./g | 0.57 |
| Average Molecular Weight | 484 |
| Oil, wt.% | 5.2 |
| Hexane, wt.% | 68.2 |
| Water, wt.% | 0.3 |
| Sulfonic Acid, wt.% | 26.6 |

Generally speaking, it is convenient and it is preferred to use the oil-soluble sulfonic acids in solution in a volatile hydrocarbon solvent, such as heptane or hexane, and such volatile hydrocarbon solvent can constitute the volatile organic solvent ingredient of the initial starting composition used in the practice of the process of our present invention or it may be supplemented by added volatile organic solvent where this may be desired.

The volatile organic solvents or process solvents which can be used in the practice of the process of our invention include, among others, the aliphatic hydrocarbon solvents disclosed in the aforesaid U.S. Pat. No. 3,865,737, having a boiling point below about 300° F. at atmospheric pressure, examples of which there given are heptane, hexane and petroleum naphtha, and additional examples of which are isohexane, 2-methylhexane, n-octane; and, also, such organic solvents as cyclohexane and 1,1-Dimethylcyclohexane. However, as indicated above, where said patent states that aromatic solvents (e.g. benzene) do not appear to work in the process of said patent, they have been found to be operative and satisfactory in our particular process in accordance with our present invention. Such aromatic hydrocarbon solvents include not only benzene but, also, toluene, o-xylene, m-xylene, p-xylene, and mixed xylenes, ethyl benzene, n-propylbenzene and mineral spirits; as well as chlorinated hydrocarbons such as trichlorethane, tetrachlormethane, and the like.

The alcohols which are useful in the practice of the process of our invention are, generally, those which are disclosed in the aforesaid U.S. Pat. No. 3,865,737, namely, the $C_1$–$C_6$ aliphatic alcohols and the alkoxy ethanols which contain from 3 to 7 carbon atoms and illustrative examples of which include methanol, ethanol, propanol, isopropanol, butanol, isobutanol, pentanols, hexanols, methoxy ethanol, ethoxy ethanol and butoxy ethanol, as well as ether-alcohols such as monomethyl ether of ethylene glycol (methyl "Cellosolve"), monoethyl ether of ethylene glycol (ethyl "Cellosolve"), and mixtures of two or more of such alcohols. Mixtures of methanol and methyl "Cellosolve" are highly satisfactory. Excellent results are also obtained with methanol as the sole alcohol and its use is preferred particularly from the standpoint of economics.

The nonvolatile diluent oils which are used in the carrying out of the process of our invention include both natural and synthetic materials, and they are disclosed in column 7 of the aforesaid U.S. Pat. No. 3,865,737 the disclosure with respect to which is incorporated and included herein by reference. Mineral lubricating oils are the nonvolatile diluents of choice. The nonvolatile diluent oils should have a boiling point in excess of about 320° F. at atmospheric pressure but, preferably, somewhat higher, generally of the order of about 350° to about 400° F. or even higher. Such nonvolatile diluent oils are, as noted above, most desirably, mineral oils of paraffinic, naphthenic or asphaltic base character, or mixtures thereof, and lubricating oils derived from coal products, although in place thereof, synthetic lubricating oils can be used such as polymers of propylene; polymers of polyoxypropylenes; synthetic hydrocarbon lubricating oils derived from $C_8$–$C_{12}$ alpha-olefins; vegetable oils such as cottonseed oil, corn oil and castor oil; animal oils such as lard oil and sperm oil; and mixture of two or more of such and other diluent oils. The nonvolatile diluent oil serves, among other things, to control the viscosity of the reaction mixture. It may, however, here be noted that, after the carbonation step of the process of our invention, nonvolatile diluent oil, or additional nonvolatile diluent oil can be added if some was added in the initial mixture at the beginning of the process, to produce a final composition having a desired viscosity and, also, a desired concentration of the magnesium in the form of its colloidally dispersed compounds.

As described above, during the earlier stages of the carbonation step of the process of our invention, activators are especially advantageously added which, as in the case of U.S. Pat. No. 3,865,737, comprise a small amount of ammonia or ammonium compounds including, illustratively, ammonium hydroxide, ammonium carbonate, ammonium chloride, ammonium sulfate, ammonium carboxylates, and ammonium sulfonates, and mixtures of two or more thereof. Particularly desirably, the activator is utilized and incorporated into the reaction mixture in the form of a solution of methanol (and/or methyl "Cellosolve"), water and ammonia, the latter two ingredients being supplied by aqueous ammonia or ammonium hydroxide, for instance, commercial ammonium hydroxide (28% $NH_3$). The amount of activator used, as noted above, is added gradually during the first approximately 10 to 60 minutes of the carbonation, most desirably during the first about 20 to about 40 minutes and particularly for about 30 minutes, where the total carbonation time may, for instance, take place in a period of about 1½ to 2 or 2½ hours. The foregoing time factor influences the % sediment which winds up in the carbonated product prior to the sediment removal or centrifugation treatment. Thus, for instance, in various runs, where the addition of the activating composition was effected gradually and reasonably uniformly in the initial period of 30 minutes of a 2-hour carbonation period, the % sediment was 3%; where the initial period of addition of the activating composition was 42 minutes the % sediment was 3.6%; where the initial period of addition of the activating composition was 60 minutes the sediment was 8.5%; and where the total amount of activating composition was added within 1 minute after initiation of the 2-hour carbonation period, the sediment was 12%.

With further regard to the particular ingredient or ingredients of the activating compositions, taking as the "standard" a composition containing 39.3 g ammonium hydroxide (28% $NH_3$), 22.5 g methanol and/or methyl "Cellosolve", and 67.5 g water, which is regarded as optimum, the proportions of said ingredients are variable to a relatively substantial extent without unduly adversely affecting the % sediment in the product prior to the centrifugation step, as is shown in tests set forth in the following Tables III, IV and V showing variabilities in the % of ammonia, water and methanol or methyl "Cellosolve."

Table III

| Example | Ammount Ammonia | % Sediment in Finished Product |
|---|---|---|
| A | Standard | 3 |
| B | + 10% | 6 |
| C | + 20% | 6 |
| D | − 10% | 3.5 |
| E | − 20% | 3.3 |
| F | − 30% | 5.2 |

Table IV

| Example | Amount Water | % Sediment In Finished Product |
|---|---|---|
| A[1] | Standard | 3 |
| B[1] | + 10% | 3.4 |
| C[1] | + 20% | 3 |
| D[1] | + 30% | 2.8 |
| E[1] | − 10% | 5 |
| F[1] | − 20% | 5 |
| G[1] | − 30% | 6.8 |

While increase in water, as indicated in Table IV, has a slight beneficial effect, it is generally desirable to hold the water as low as is reasonably possible because of the effect of the water on the dispersed magnesium carbonate/hydroxide which, coupled with time of contact during the later distillation step, tends to cause crystal growth with resulting undesired haze or sediment in the finished product.

TABLE V

In the following Examples, methyl "Cellosolve" was used in the "standard" activating composition and the effect of variations in proportions thereof determined. Generally similar results are obtained where methanol is used in the "standard" activating composition.

| Example | Amount of Methyl "Cellosolve" | % Sediment in Finished Product |
|---|---|---|
| A" | Standard | 3 |
| B" | + 10% | 3.2 |
| C" | + 30% | 4.6 |
| D" | + 50% | 4.4 |
| E" | − 10% | 4 |
| F" | − 30% | 5.6 |
| G" | − 50% | 6 |

Generally speaking, there is substantial flexibility in the variability of the proportions of the ingredients in the "standard" activating composition without unduly adverse effects so far as the % sediment is concerned.

The proportions of certain of the materials used in the carrying out of the process of our invention are variable within reasonable limits and some are not critical but are governed by practical considerations, as approximately noted below in terms of parts by weight:

| Material | Suitable | Preferred |
|---|---|---|
| Oil-soluble sulfonic dispersing agent composition | 75–125 | 85–115 |
| Volatile solvent | 100–500 | 200–400 |
| Alcohol | 2–10 | 4–8 |
| Nonvolatile diluent oil | 100–250 | 125–200 |
| Water | 0.5–20 | 5–15 |
| Magnesium oxide[1] | 10–125 | 60–110 |
| Activator[2] | 0.6–9 | 1–5 |

[1]Over and above amount used to neutralize oil-soluble sulfonic acid composition.
[2]Calculated as $NH_3$. In the case of the type of the activator composition used in the Examples, from about 5–25 parts of the alcohol, from about 20–60 parts of water, and from 3–10 parts $NH_3$, by wt.

The following Examples are illustrative, but in no way limitative, of the process of the present invention. Other Examples will be readily apparent to those skilled in the art in light of the guiding principles and teachings disclosed herein.

EXAMPLE 1

A 5,000 ml, 3-neck creased distillation flask of the vertical type with rounded bottom, equipped with a mechanical mixer, a Friedrichs condenser, thermometer, and gas addition tube, and immersed in a cooling water bath, is charged with 1,000 g of the hexane solution of the sulfonic acid the analysis of which has been described above, and with 17.2 g of commercial methanol. The mixture is well mixed and then 11.6 g of activated magnesium oxide are added to neutralize the sulfonic acid. The temperature rises from 74° F. to 96° F. due to the heat of neutralization. After several minutes of mixing, 153.9 g of activated magnesium oxide is added for overbasing. An increase of about 1° F. results from this addition. After mixing well, the composition is carbonated by means of a gas dispersion tube placed below the surface of the liquid. A flow rate of $CO_2$ addition of about 0.21 liters/min. is used and the total addition time is about 2 hours; Flowmeter rating is set to deliver the $CO_2$ evenly throughout the 2-hour carbonation. During the first 30 minutes of the carbonation, a previously prepared activator solution is added at a constant rate below the surface of the stirring mixture. This activator solution consists of 39.3 g ammonium hydroxide (28% $NH_3$), 22.5 g commercial methanol and 67.5 g water.

The following typical or illustrative schedule for the carbonation and addition of the activator mixture is used which is as follows:

| Time, Minutes | Temperature, ° F. | % $NH_3$—$H_2O$—MeOH Mixture Added |
|---|---|---|
| 0 | 94 | 0 |

-continued

| Time, Minutes | Temperature, ° F. | % $NH_3$—$H_2O$—MeOH Mixture Added |
|---|---|---|
| 10 | 95 | 33 |
| 12 | 97 | 40 |
| 20 | 113 | 66 |
| 30 | 118 | 100 |
| 40 | 121 | — |
| 50 | 122 | — |
| 60 | 124 | — |
| 70 | 125 (Peak) | — |
| 80 | 123 | — |
| 90–120 | 120 | — |

Following the carbonation, 356 g of 500-viscosity (at 100° F.) naphthenic lubricating diluent oil is added to the mixture and the post-carbonation mixture/diluent oil is cooled to about 100° F. to stabilize the colloidal dispersion. The sediment is then removed via single-step centrifugation prior to removal of the process solvents. Following centrifugation, the volatile solvents are removed by distillation to 300° F. The final product shows the following composition:

| | |
|---|---|
| 29.2% | Magnesium Sulfonate |
| *0.05% | Sediment |
| 421 | Total Base Number |

*The sediment is 4% after the carbonation step, prior to clarification by centrifugation.

This sediment value after carbonation reflects the effective utilization of the activated magnesium oxide.

EXAMPLE 2

This Example illustrates what is regarded as the best or one of the best embodiments of our invention where the final colloidal magnesium sulfonate dispersion has a TBN in excess of 550.

| Ingredients Used: | | |
|---|---|---|
| Sulfonic Acid in Hexane[1] | 1000 | g |
| Methanol | 56.6 | g |
| Activated Magnesium Oxide | 256.7 | g |
| Non-volatile Diluent Oil[2] | 253.3 | g |
| Water | 118.0 | g |
| Ammonium Hydroxide (28% NH 3) | 68.6 | g |

[1]Same as used in Example 1.
[2]Same as used in Example 1.

The same procedures are used as described in Example 1 with the exception that the amount of activator solution, activated magnesium oxide and nonvolatile diluent oil are varied to the extent dictated by the final finished product desired to be prepared in this Example 2. The said finished product is a bright fluid having a TBN of 565 and a % of sediment of 0.08 (prior to clarification by centrifugation, the % of sediment is 7).

EXAMPLES 3, 4, 5 AND 6

These Examples each follow the procedure and the proportions of ingredients used as described in Example 1, except that, in place of hexane as the volatile organic solvent, the organic solvents indicated in Examples 4, 5 and 6 in Table VI below are used. The final, finished products in each Example are fluid and bright.

Table VI

| Example | Organic Solvent | Sediment % (before centrifugation) | TBN |
|---|---|---|---|
| 3 | Hexane | 2.6 | 380 |
| 4 | Toluene | 3.6 | 370 |

Table VI-continued

| Example | Organic Solvent | Sediment % (before centrifugation) | TBN |
|---|---|---|---|
| 5 | 1,1,1 - Trichloroethane | 4.8 | 384 |
| 6 | Mineral Spirits | 2.8 | 381 |

The finished compositions of the present invention, as noted above, are bright fluids the viscosities of which are variable but are generally somewhat below 2,000 centistokes measured at 100° F.

What we claim is:

1. In a process for preparing a stable fluid highly-basic, magnesium-containing colloidal dispersion, which includes the steps of:

(a) forming a fluid admixture of:

(1) an acidic oil-soluble dispersing agent selected from the group consisting of oil-soluble sulfonic acids, and mixtures of oil-soluble sulfonic acids and oil-soluble aliphatic hydrocarbon monocarboxylic acids;

(2) a volatile organic solvent selected from the group of hydrocarbon and chlorinated hydrocarbon solvents having a boiling point below about 300° F.; and (3) a minor proportion of an alcohol selected from the group of $C_1$ to $C_6$ aliphatic alcohols, alkoxy ethanols containing 3 to 7 carbon atoms, and $C_1$ to $C_6$ alkyl mono-ethers of lower glycols;

(b) adding to said admixture of step (a), under conditions of agitation, an amount of activated magnesium oxide initially sufficient to neutralize the acidic dispersing agent and additionally to provide an overbasing amount of the activated magnesium oxide;

(c) treating the reaction mixture of step (b) with 75% (±10%) of the stoichiometric quantity of carbon dioxide per mole of overbasing magnesium present by the gradual addition of said carbon dioxide while maintaining the reaction mixture at a temperature in the range of about 70 to about 125° F.;

(d) during the early and through a partially continued stage of the carbonation of step (c) adding to the reaction mixture an activator in the form of ammonia or an ammonium compound;

(e) after the carbonation step has been essentially completed, adding a non-volatile diluent oil having a boiling point above about 320° F.; and (f) bringing the reaction mixture from step (e) to a temperature not exceeding about 100° F. whereby stabilization of the resulting colloidal dispersion is effected for a period of time within the range of at least about 24 hours.

2. The process of claim 1, in which the magnesium-containing colloidal dispersion obtained in step (f) is treated to effect removal of sediment whereby to produce a substantially clear colloidal dispersion, and then removing volatile materials from said dispersion by heating it to an elevated temperature whereby to produce a highly-basic magnesium-containing dispersion in which any sediment which may be present does not exceed about 0.1%.

3. The process of claim 1, in which the oil-soluble sulfonic acids are selected from the group consisting of mixtures of monoalkylbenzenes and dialkylbenzenes in which the dialkylbenzenes predominate and in which the alkyl groups are branched chain or linear and contain predominately from 12 to 16 carbon atoms.

4. The process of claim 1, in which the volatile organic solvent is aliphatic.

5. The process of claim 4, in which the volatile organic solvent is hexane.

6. The process of claim 1, in which the volatile organic solvent is aromatic.

7. The process of claim 1, in which the alcohol is a member selected from the group consisting of methanol and the monomethyl ether of ethylene glycol, and mixtures thereof.

8. The process of claim 1, in which the activator is a solution containing ammonia, water and at least one alcohol selected from the group consisting of methanol and the monomethyl ether of ethylene glycol.

9. The process of claim 1, in which the carbonation step is carried out for a period of about 1½ to about 2½ hours and during substantially the first about 20 to about 40 minutes thereof the activator is gradually added to the mixture being carbonated.

10. The process of claim 1, in which the activated magnesium oxide utilized is one which, at the end of step (f), the sediment present in the magnesium-containing colloidal dispersion does not exceed about 5%.

11. The process of claim 1, in which the activated magnesium oxide utilized is one which is characterized by the following properties:

| | |
|---|---|
| Iodine Number | 40 (minimum) |
| Crystal Size | 150 to 400Å |
| Bulk Density | 18 to 25 lbs/cu. ft. |
| Surface Area | 40 to 70 $M^2/g$. |
| Ignition Loss | 6.0 wt. % (maximum) |
| Acid Neutralization Time (A.N.T.) | 12 sec. (maximum). |

12. A process for preparing a fluid, highly-basic, magnesium-containing colloidal dispersion wherein the process comprises:

(a) forming an admixture in parts by weight of:
  (1) about 75 to about 125 parts of an acidic oil-soluble dispersing agent selected from the group consisting of oil-soluble sulfonic acids, and mixtures of oil-soluble sulfonic acids and oil-soluble aliphatic hydrocarbon monocarboxylic acids;
  (2) about 100 to about 500 parts of a volatile organic solvent selected from the group of hydrocarbon and chlorinated hydrocarbon solvents having a boiling point below about 300° F.; and
  (3) about 2 to about 10 parts of an alcohol selected from the group of $C_1$ to $C_6$ aliphatic alcohols, alkoxy ethanols containing 3 to 7 carbon atoms, and $C_1$ to $C_6$ alkyl monoethers of lower glycols;

(b) adding to said admixture of step (a), under conditions of agitation, an amount of activated magnesium oxide initially sufficient to neutralize the acidic dispersing agent and additionally about 10 to about 125 parts of activated magnesium oxide to provide an overbasing amount of the activated magnesium oxide;

(c) treating the reaction mixture of step (b) with 75% (±10%) of the stoichiometric quantity of carbon dioxide per mole of overbasing magnesium present by the gradual addition of said carbon dioxide while maintaining the reaction mixture at a temperature in the range of about 70 to about 125° F.;

(d) during the early and through a partially continued stage of the carbonation of step (c) adding to the reaction mixture an activator in the form of ammonia or an ammonium compound in an amount sufficient to provide from about 0.6 to about 9 parts ammonia;

(e) after the carbonation step has been essentially completed, adding a nonvolatile diluent oil having a boiling point above 320° F.;

(f) bringing the reaction mixture from step (e) to a temperature not exceeding about 100° F. whereby stabilization of the resulting colloidal dispersion is effected for a period of time within the range of at least about 24 to about 240 hours;

(g) effecting removal of sediment to produce a substantially clear colloidal dispersion; and (h) removing volatile materials by heating whereby to produce a final highly-basic magnesium-containing substantially clear colloidal dispersion.

13. The process of claim 12, in which the oil-soluble sulfonic acids are selected from the group consisting of mixtures of monoalkylbenzenes and dialkylbenzenes in which the dialkylbenzenes predominate and in which the alkyl groups are branched chain or linear and contain predominately from 12 to 16 carbon atoms.

14. The process of claim 12, in which the oil-soluble sulfonic acid is present in proportions of about 85–115 parts and the volatile organic solvent is present in proportions of about 200–400 parts.

15. The process of claim 12, in which the volatile organic solvent is aliphatic.

16. The process of claim 15, in which the volatile organic solvent is hexane.

17. The process of claim 12, in which the volatile organic solvent is aromatic.

18. The process of claim 12, in which the alcohol is a member selected from the group consisting of methanol and the monomethyl ether of ethylene glycol, and mixtures thereof.

19. The process of claim 12, in which the activator is a solution containing ammonia, water and at least one alcohol selected from the group consisting of methanol and the monomethyl ether of ethylene glycol.

20. The process of claim 19, in which the activator solution contains about 39 parts (±30%) ammonium hydroxide (28% $NH_3$), and about 22 parts (±30%) methanol, and about 67 parts (±30%) water.

21. The process of claim 12, in which the carbonation step is carried out for a period of about 1½ to about 2½ hours and during substantially the first about 20 to about 40 minutes thereof the activator is gradually added to the mixture being carbonated.

22. The process of claim 12, in which the activated magnesum oxide utilized is one which, at the end of step (f), the sediment present in the magnesium-containing colloidal dispersion does not exceed about 5%.

23. The process of claim 12, in which the activated magnesium oxide utilized is one which is characterized by an acid neutralization time of about 12 seconds maximum and an ignition loss of about 6%.

24. The process of claim 12, in which the activated magnesium oxide utilized is one which is characterized by the following properties:

| | |
|---|---|
| Iodine Number | 40 (minimum) |
| Crystal Size | 150 to 400 Å |
| Bulk Density | 18 to 25 lbs/cu.ft. |
| Surface Area | 40 to 70 $M^2/g$ |
| Ignition Loss | 6.0 wt. % (maximum) |
| Acid Neutralization Time (A.N.T.) | 12 sec. (maximum) |

25. The process of claim 12, in which the nonvolatile diluent oil to step (e) is selected from the group consisting of mineral lubricating oils and synthetic lubricating oils.

26. The process of claim 12, in which the amount of the alcohol in step a(3) is from 4 to 8 parts.

27. The process of claim 12, in which the TBN of the finished magnesium-containing colloidal dispersion is at least about 500.

28. The process of claim 12, in which the amount of sediment in the finished magnesium-containing colloidal dispersion is not in excess of about 0.1%.

* * * * *